US006575585B2

(12) United States Patent
Nelson et al.

(10) Patent No.: US 6,575,585 B2
(45) Date of Patent: Jun. 10, 2003

(54) DECORATIVE STRUCTURE HAVING DISPERSED SOURCES OF ILLUMINATION

(76) Inventors: Webb T Nelson, 19180 144th Ave. NE., Woodinville, WA (US) 98072; Mark Chernick, 19180 144th Ave. NE., Woodinville, WA (US) 98072

( * ) Notice: Subject to any disclaimer, the term of this patent is extended or adjusted under 35 U.S.C. 154(b) by 0 days.

(21) Appl. No.: 09/912,659

(22) Filed: Jul. 25, 2001

(65) Prior Publication Data

US 2003/0021101 A1 Jan. 30, 2003

(51) Int. Cl.[7] ..... F21V 33/00
(52) U.S. Cl. ..... 362/35; 362/276; 362/806
(58) Field of Search ..... 362/35, 96, 276, 362/806, 296; 40/441, 480, 431, 432, 502; 446/47, 48, 217, 218, 176, 201, 236

(56) References Cited

U.S. PATENT DOCUMENTS 1,132,187 A * 3/1915 Keyte ..... 40/441
1,743,433 A * 2/1930 Genest ..... 40/441
6,036,331 A * 3/2000 Acquisto ..... 362/96

* cited by examiner

*Primary Examiner*—Y. My Quach-Lee
(74) *Attorney, Agent, or Firm*—LaMorte & Associates

(57) ABSTRACT

An illuminated assembly that can be configured as a pinwheel, pinwheel bow or decorative bow. The illuminated assembly includes segments of material that are folded over to form looped structures. At least some of the segments of material have a laminated structure, wherein two pieces of material are attached together. In the laminated segments of material are placed miniature light emitting diodes (LEDs). The wires that provide power to the LEDs travel through the segments of material in between the laminated layers. In the center of the assembly is a hub. In the hub are a power source and a control circuit. Each of the LEDs present in the assembly, interconnects with the control circuit in the hub. The control circuit contains a motion sensor and lights the LEDs only when motion is detected.

18 Claims, 4 Drawing Sheets

DECORATIVE STRUCTURE HAVING DISPERSED SOURCES OF ILLUMINATION

BACKGROUND OF THE INVENTION

1. Field of the Invention

The present invention relates to decorative structures that are illuminated with multiple light sources. More particularly, the present invention relates to decorative structures, such as pinwheels, bows and folded ribbons that are illuminated using multiple light sources.

2. Prior Art Statement

Traditional decorative bows are typically made from looped strips of paper or fabric that are folded in a symmetrical pattern. Decorative bows are commonly used as decorations on packages. Such bows are also used as Christmas tree decorations, door decorations, wall hangings and the like. A variation of the folded bow is the pinwheel. In a pinwheel, material is folded and looped to form vanes instead of decorative loops. The center of each folded vane is then attached to an axle pin. This enables the folded vanes of the pinwheel to turn as the vanes of the pinwheel catch the wind. Pinwheels, like traditional bows, are also used to adorn packages and form decorative objects.

Typically, the aesthetic value of a bow or pinwheel relies greatly on the material used to form that object and the complexity of the folds used in its creation. For this reason, bows and pinwheels are often made from brightly colored and/or decorated materials. In an attempt to make bows and pinwheels even more noticeable, illumination sources have been added to bows and pinwheels. The illumination sources illuminate the folds of the bow or pinwheel, thereby making the structure more noticeable, especially in low light conditions.

Traditional decorative bows are stationary objects. As such, illuminating a traditional bow is not a complex endeavor. Illumination sources are placed into the bow. If multiple illumination sources are used, the various illumination sources are connected in series with wire. The wire is then hidden within the folds of the bow. The problems associated with illuminating a bow is that room must be made in or around the bow to hold the batteries for the lights. Furthermore, the cost of the batteries and illumination sources typically cost much more than does the bow itself. An example of an illuminated bow is shown in U.S. Pat. No. 6,174,072 to Root, Jr., entitled Illuminated Ornamental Apparatus.

In a pinwheel, the vanes of the pinwheel turn in the wind. As such, it is much more difficult to illuminate the vanes of a pinwheel. To electrically illuminate any object, there must be a light and a power source for that light. As such, to electrically illuminate a pinwheel, lights and a power source must be added to the pinwheel. Traditional lights require the use of batteries that are fairly heavy. Such batteries cannot be placed on the vanes of a pinwheel because the added mass would make the pinwheel too heavy to be turned by a light wind. As a consequence, batteries are not placed on the vanes. Individual lights on the vanes can be joined to a stationary common power source using wiping contacts. However, such an assembly is very expensive to manufacture. A cheaper way to illuminate a pinwheel is to provide a stationary source of illumination that emits light towards the moving vanes. A pinwheel with a stationary internal source of illumination is shown in U.S. Pat. No. 2,857,507 to Stec, entitled Electric Lawn Ornament. A pinwheel that relies upon external light for illumination is exemplified by U.S. Pat. No. 5,092,809 to Kessler, entitled Pinwheel Toy. However, stationary light source tend not to be as visually interesting as are moving light sources.

The problems associated with illuminating a pinwheel at multiple points is the same as those illuminating a bow at multiple points. The cost and complexity of running multiple lights to a single power source is cost prohibitive. Additionally, the room required for the single power source and the wires that must run to the single power source complicates the structure of the pinwheel. Issues of cost, balance and the weight of the vanes prevent illumination sources from being applied directly to the vanes of the pinwheel.

A need therefore exists for a low cost way to illuminate a pinwheel or bow at multiple points on the folds of these structures without detracting from their appearance or performance. This need is met by the present invention as described and claimed below.

SUMMARY OF THE INVENTION

The present invention is an illuminated assembly that can be configured as a pinwheel, pinwheel bow or decorative bow. The illuminated assembly includes segments of material that are folded over to form looped structures. Depending on the shape of the segment of material and the manner in which those segments are folded, the folded looped structures can form a pinwheel or a bow. At least some of the segments of material have a laminated structure, wherein two pieces of material are attached together. Miniature light emitting diodes (LEDs) are placed within the laminated segments of material. The wires that provide power to the LEDs travel through the segment of material in between the laminated layers.

In the center of the assembly is a hub. In the hub are a power source and a control circuit. Each of the LEDs, present in the assembly, interconnects with the control circuit in the hub. The control circuit contains a motion sensor and lights the LEDs only when motion is detected.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
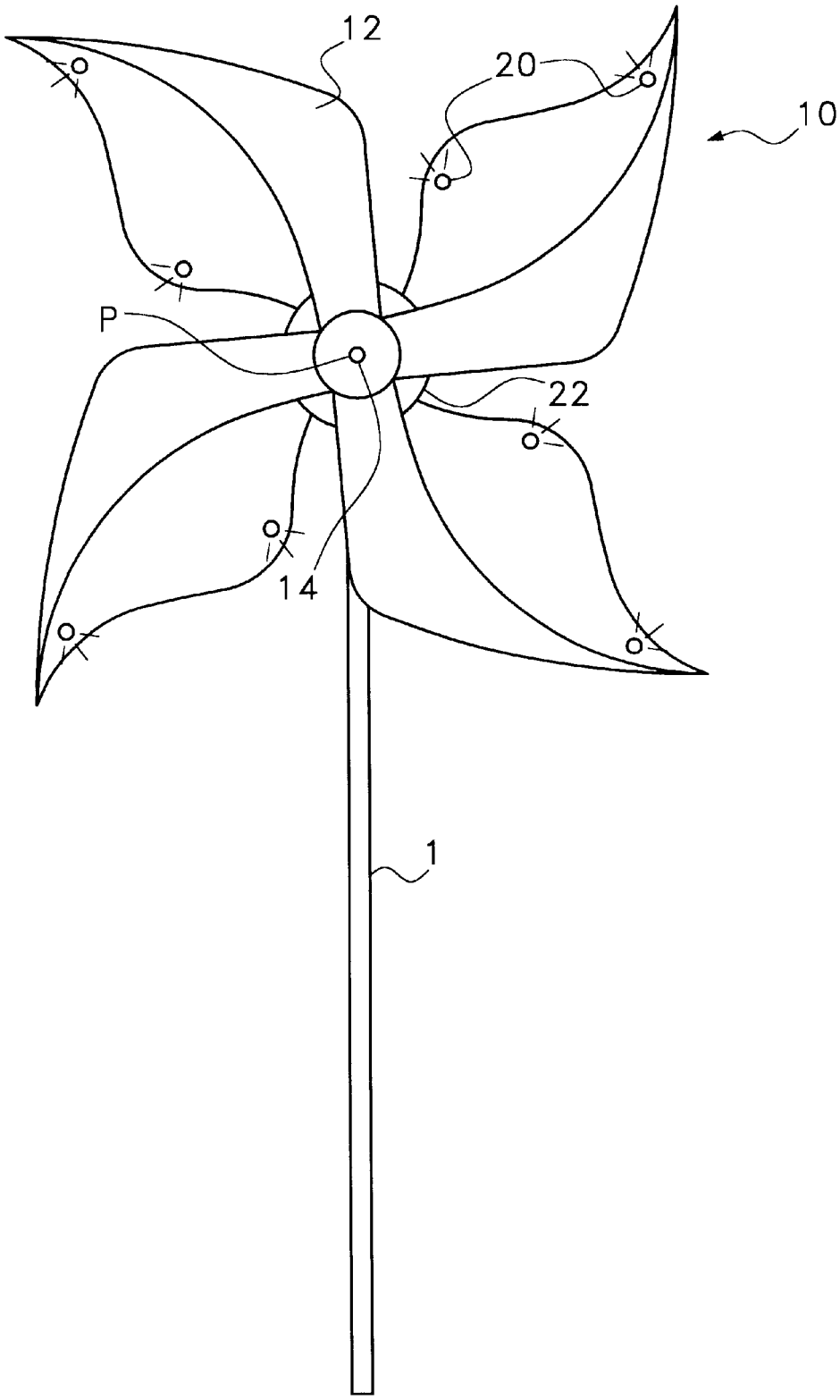
FIG. 1 is a front view of a pinwheel assembly made in accordance with the present invention.

Referring to FIG. 1, an exemplary embodiment of the present invention device is shown. The shown embodiment is that of a pinwheel 10. The pinwheel 10 contains a plurality of folded vanes 12 that radially diverge from a central point of rotation P. An axle pin 14 extends through the material of the folded vanes 12 at the central point of rotation P. The folded vanes 12 are symmetrically disposed around the axle pin 14. As such, the vanes 12 are balanced about the axle pin 14 and are free to rotate around the axle pin 14. The vanes 12 are all folded over and angled in a common direction. As such, when the folded vanes 12 catch the wind, a propeller action is created and the folded vanes 12 rotate about the axle pin 14.

The axle pin 14 engages a stick 16 behind the folded vanes 12. The stick 16 is used to support the folded vanes 12 and to help move the folded vanes 12 through the wind.

On each of the vanes 12 of pinwheel 10 is located at least one light emitting diode (LED) 20. The location of each of the LEDs 20 on each of the folded vanes 12 is approximately the same. As such, the presence of the LEDs does not adversely affect the balance of the folded vanes 12 around the axle pin 14. Furthermore, the LEDs are miniature, having a diameter of approximately two millimeters and a height no greater than its diameter. Such miniature LEDs, have a weight of only a few grams each. As such, the presence of the LEDs 20 on the folded vanes 12 do not add significantly to the mass of the vanes 12 and therefore do not adversely effect the inertia of the pinwheel 10 and its ability to spin in the lightest of breezes. A source of the miniature LEDs is Jyco Inc., of Taipei, Taiwan.

Each of the LEDs 20 on the various vanes 12 of the pinwheel 10 must be coupled to a power source to operate. In the shown embodiment, a single power source is used to power all of the LEDs 20. The power source is part of a hub assembly 22 that is located in the center of the pinwheel 10. As will be later explained, the hub assembly 22 spins with the pinwheel 10 around the axle pin 14. As such, there is no relative movement between the hub assembly 22 and the LEDs 20 as the pinwheel 10 spins.

Figure 2:
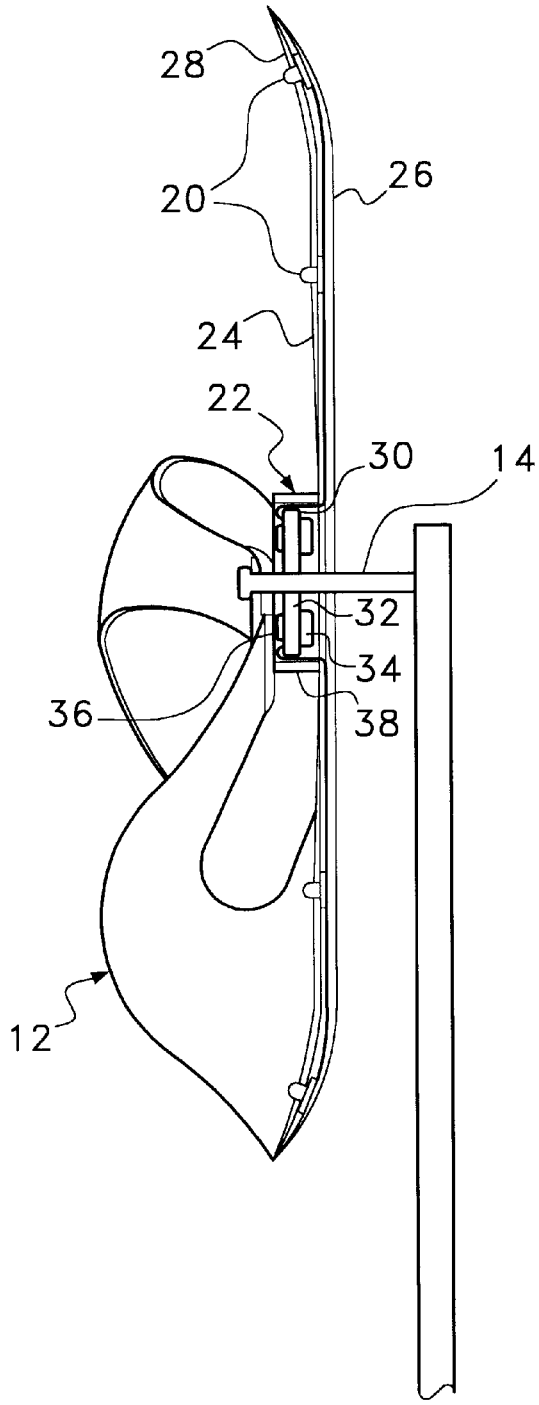
FIG. 2 is a selectively cross-sectioned view of the device shown in FIG. 1.

Referring to FIG. 2, it can be seen that each of the vanes 12 of the pinwheel 10 is made of a laminated structure. The laminated structure includes a front material layer 24 and a rear material layer 26 that are glued together. The layers 24, 26 can be made from any material or fabric. However, in a preferred embodiment, Mylar is used. By using two layers of material that are laminated together, the vanes 12 are provided with increased strength and rigidity. Furthermore, the use of two different layers 24, 26 enables a manufacturer to change the material, color and/or pattern between the front material layer 24 and the rear material layer 26. In the construction of the pinwheel 10, each vane 12 is folded over to form the cupped structure that is the vane 12. As such, any person viewing the front of the pinwheel 10 would view both the front material layer 24 and the rear material layer 26 on each vane 12. By varying the material, color and/or pattern between the front material layer 24 and the rear material layer 26, a more visually interesting pinwheel 10 can be formed.

Small apertures 28 are formed in the front material layer 24 of the vanes 12. The LEDs 20 protrude through these small apertures 28 and are therefore visible on the front of the pinwheel 10. The LEDs 20 on each vane 12 can be joined in either a parallel or serial construction. Wires 30 are used to interconnect the LEDs 20 that are positioned within the laminated structure of the vanes 12 in between the front material layer 24 and the rear material layer 26. The wires 30 also propagate through the vanes 12 to the hub assembly 22 in the same manner. Since the wires 30 used to power the LEDs 30 are located within the laminated structure of the vane 12, the wires 30 are not visible and do not interfere with the operation of the pinwheel 10. Furthermore, the gauge of the wires 30 used is very small. As such, the wires 30 do not add significantly to the mass of the vanes 12 and have no appreciable effect on the pinwheel's ability to spin.

In the center of the pinwheel 10 is located the hub assembly 22. The hub assembly 22 contains the power source for the various LEDs 20 and the control circuitry that selectively controls the operation of the LEDs 20. Within the hub assembly 22 is located a circular circuit board 32. A hole is disposed in the center of the circuit board 32, thereby giving the circuit board 32 an annular shape. The hole in the center of the circuit board 32 is sized to receive the axle pin 14, around which the pinwheel spins.

Multiple batteries 34 are used to power the LEDs 20. The batteries 34 are supported by the circuit board 32 and are symmetrically disposed around the center of the circuit board 32. In this manner the circuit board 32 remains balanced around the axle pin 14 that passes through the center of the pinwheel 10. Circuitry is disposed on the side of the circuit board 32 opposite the batteries 34. The wires 30 from the various LEDs 20 connect to this circuitry. The circuitry includes a motion sensor 36. The motion sensor 36 detects when the hub assembly 22 is moving and interconnects the LEDs 20 to the power of the batteries 34 only during movement and preferably for a short period of time after movement is ceased. Many such circuits that are motion activated exist in the prior art. Any such circuit can be adapted for use with the present invention.

The hub assembly 22 is supported by the center of the laminated material that makes up the vanes 12. The front of the hub assembly 22 is covered by the tips of the folded vanes 12 that fold over the hub assembly 22 and connect to the axle pin 14 that extends through the center of the hub assembly 22. The sides of the hub assembly 22 can be protected by a small extra strip of material 38 that is glued around the periphery of the hub assembly 22.

Returning to FIG. 1, it will be understood that as the vanes 12 of the pinwheel 10 catch the wind and turn, the hub assembly 22 in the center of the pinwheel 10 also turns. The movement of the hub assembly 22 is detected by the motion sensor in the circuitry of the hub assembly 22, wherein power is fed to the various LEDs 20 on the vanes 12. Consequently, as the pinwheel 10 spins, the LEDs 20 on the vanes 12 of the pinwheel 10 become illuminated. When the vanes 12 of the pinwheel 10 come to a stop, the hub assembly 22 no longer senses movement and the LEDs 20 shut off. The result is a pinwheel 10 that is illuminated only when it catches the wind, thereby making a pinwheel 10 that illuminates only when played with or used in the wind. This greatly prolongs battery life and the useful life of the overall assembly.

Figure 3:
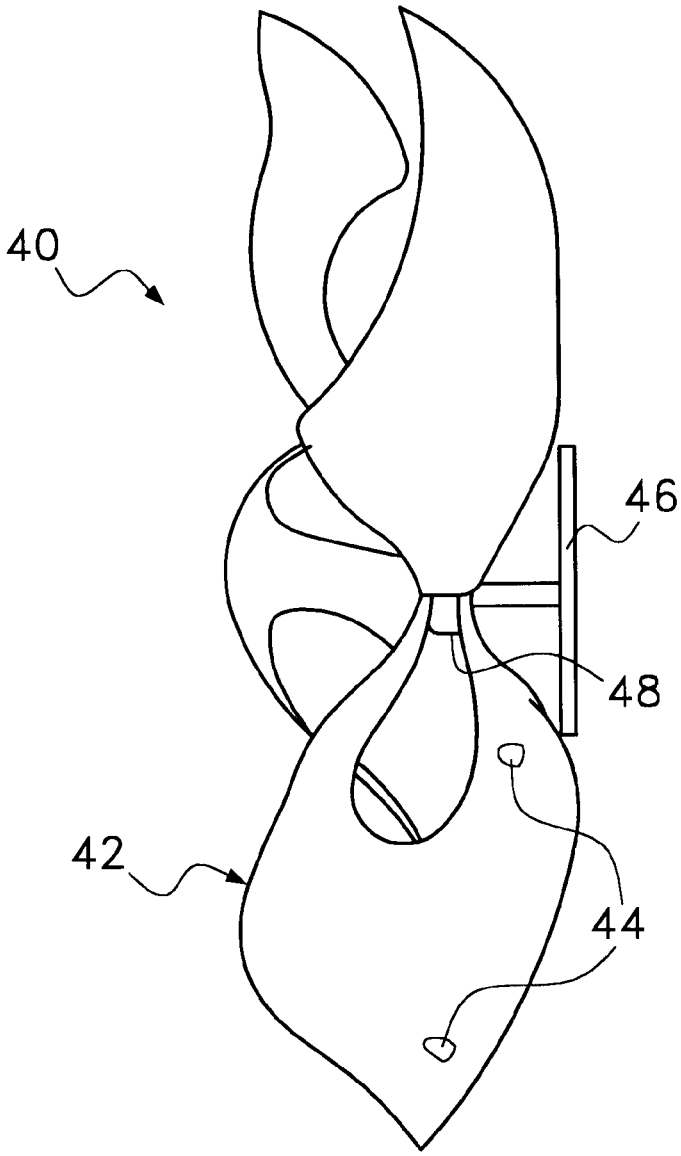
FIG. 3 is a perspective view of a pinwheel bow made in accordance with the present invention.

Referring to FIG. 3, a pinwheel bow 40 is shown. In this embodiment, a gift bow is provided that has vanes 42 that can rotate as a pinwheel. On each of the vanes 42 is located LEDs 44 of the type previously described. In the center of the pinwheel bow 40 is a hub assembly 46 of the configuration previously described. Below the hub assembly 46 is an adhesive plate 48 that is used to join the pinwheel bow 40 to a package. When the pinwheel bow 40 is at rest, the hub assembly 46 will sense no motion and the LEDs 44 contained in the vanes 42 will not be lit. However, when a package with the pinwheel bow 40 is being handed to a person, or is being unwrapped by a person, then the pinwheel bow 40 will experience motion. Once motion is detected, the LEDs 44 on the vanes 42 will light. As such, just as a person is handed a present, the pinwheel bow 40 will begin to illuminate.

Figure 4:
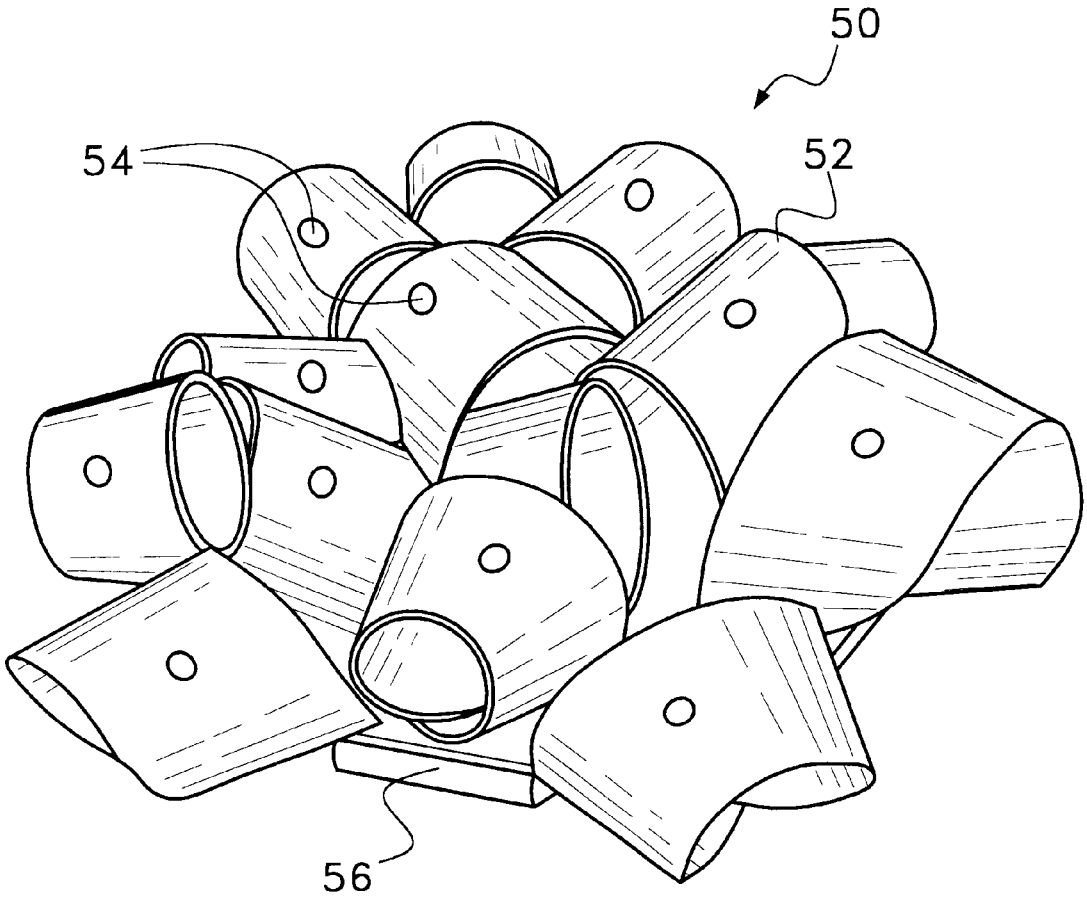
FIG. 4 is a side view of a decorative bow made in accordance with the present invention.

Referring to FIG. 4, an embodiment of the present invention is shown configured as a stationary decorative bow 50. In this embodiment, a traditional bow configuration is shown, wherein several bow loops 52 radially extend from a common point to create a bow. On at least some of the bow loops 52 are provided LEDs 54 of the type previously described. The bow loops 52 of the bow 50 are made from two laminated pieces of material. The wires that power the LEDs 54 are located between the laminated pieces of material, as was previously described with regard to FIG. 2. The wires from the LEDs 54 extend to a hub assembly 56.

The hub assembly 56 can be located at any point on the base of the decorative bow 50 and need not be in the center of the bow 50. The hub assembly 56 does not move. Accordingly, the hub assembly 56 need not be symmetrically balanced and no aperture is needed in the hub assembly 56 for an axle pin to pass. In all other manners, the hub assembly 56 contains the same components as have been previously described. As such, the hub assembly 56 contains a motion sensor and lights the LEDs when the motion sensor detects movement. Consequently, when the decorative bow 50 is at rest, then no motion is sensed and the LEDs 54 are not lit. However, when a gift with the decorative bow 50 is handed to a person or unwrapped by that person, motion is sensed and the LEDs 54 light. Once lit, the LEDs 54 cause the decorative bow to be brightly illuminated.

It will be understood that the embodiments of the present invention device and method described and illustrated are merely exemplary and a person skilled in the art can make many variations to the shown embodiment. For example, there are many different types and styles of pinwheels, pinwheel bows and decorative bows. Any such type of style can be adapted for use with the present invention. Furthermore, the number of vanes, the number of LEDs and the location of the LEDs can be selectively altered. LEDs can be located on every vane or bow loop. Alternatively, LEDs can be attached only to some vanes or bow loops present in a decoration. All such alternate embodiments and modifications are intended to be included within the scope of the present invention as defined below in the claim.

What is claimed is:

1. A pinwheel assembly, comprising:

a plurality of vanes radially extending from a common central area;

at least one light disposed on at least one of said vanes;

an electronic assembly coupled to said common central area, said electronic assembly containing a motion sensor for detecting motion of said common central area and a power supply for powering said at least one light, wherein said electronic assembly only powers said at least one light from said power supply when said motion sensor detects motion of said common central area;

an axle pin extending through said common central area and said electronic assembly, wherein said plurality of vanes and said electronic assembly are free to rotate in unison around said axle pin.

2. The assembly according to claim 1, wherein each of said vanes is comprised of a front piece of material and a rear piece of material that are laminated together.

3. The assembly according to claim 2, wherein said at least one light is coupled to said electronic assembly with wire and said wire is disposed between said front piece of material and said rear piece of material in each vane.

4. The assembly according to claim 1, wherein said electronic assembly includes a central aperture through which said axle pin passes.

5. The assembly according to claim 4, wherein said electronic assembly is balanced about said central aperture.

6. The assembly according to claim 4, wherein said power supply is a plurality of batteries that are symmetrically oriented about said central aperture.

7. The assembly according to claim 1, wherein said at least one light is a light emitting diode.

8. The assembly according to claim 1, wherein each of said vanes contains at least one light.

9. The assembly according to claim 8, wherein each said light is symmetrically arranged around said common central area.

10. A decorative assembly, comprising:

at least one segment of material having a central point and salient points that are folded over to said central point to form loops, wherein said at least one segment of material is comprised of two pieces of laminated material;

lights disposed on at least some of said loops;

an electronic assembly coupled to said at least one segment of material, wherein said electronic assembly contains a power supply for said lights;

wires extending between said lights and said electronic assembly, wherein said wires pass between said two pieces of laminated material.

11. The assembly according to claim 10, further including a pin axle extending through said at least one segment of material and said electronic assembly, wherein said at least one segment of material and said electronic assembly are free to rotate about said axle pin.

12. The assembly according to claim 10, wherein said electronic assembly includes a motion sensor that detects motion of said electronic assembly and wherein said electronic assembly lights said lights when motion is detected.

13. A decorative assembly, comprising:

at least one segment of material having a central point and salient points that are folded over to said central point to form loops;

lights disposed on at least some of said loops;

an electronic assembly coupled to said at least one segment of material, wherein said electronic assembly contains a power supply for said lights and a motion detector that detects motion of the electronic assembly, wherein said electronic assembly lights said lights when motion of said electronic assembly is detected.

14. The assembly according to claim 13, wherein said at least one segment of material is configured as the vanes of a pinwheel.

15. The assembly according to claim 13, wherein said at least one segment of material is configured as the loops of a decorative bow.

16. The assembly according to claim 13, wherein said at least one segment of material is comprised of two pieces of laminated material.

17. The assembly according to claim 16, wherein said lights are coupled to said electronic assembly with wire and said wire is disposed between said two pieces of laminated material.

18. The assembly according to claim 13, wherein said lights are light emitting diodes.

* * * * *